US012060792B2

(12) United States Patent
Moore et al.

(10) Patent No.: US 12,060,792 B2
(45) Date of Patent: Aug. 13, 2024

(54) ROTARY STEERABLE DRILLING TOOL AND METHOD WITH INDEPENDENTLY ACTUATED PADS

(71) Applicant: Halliburton Energy Services, Inc., Houston, TX (US)

(72) Inventors: James Wilson Moore, Denver, CO (US); Jim Darin Tilley, Kingwood, TX (US); Michael Dewayne Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/335,620

(22) PCT Filed: Nov. 2, 2016

(86) PCT No.: PCT/US2016/060060
§ 371 (c)(1),
(2) Date: Mar. 21, 2019

(87) PCT Pub. No.: WO2018/084838
PCT Pub. Date: May 11, 2018

(65) Prior Publication Data

US 2019/0301244 A1 Oct. 3, 2019

(51) Int. Cl.

| | |
|---|---|
| ***E21B 7/06*** | (2006.01) |
| ***E21B 17/10*** | (2006.01) |
| ***E21B 44/00*** | (2006.01) |
| ***E21B 47/024*** | (2006.01) |

(52) U.S. Cl.
CPC ..... *E21B 7/06* (2013.01); *E21B 7/068* (2013.01); *E21B 17/1014* (2013.01); *E21B 44/00* (2013.01); *E21B 47/024* (2013.01)

(58) Field of Classification Search
CPC ..... E21B 7/06; E21B 7/068; E21B 17/1014; E21B 44/00; E21B 47/024
See application file for complete search history.

(56) References Cited

U.S. PATENT DOCUMENTS

| | | | | |
|---|---|---|---|---|
| 3,795,141 | A * | 3/1974 | Planche | E21B 17/1021 73/152.17 |
| 6,109,372 | A | 8/2000 | Dorel et al. | |
| 6,179,066 | B1 * | 1/2001 | Nasr | E21B 47/01 175/45 |
| 8,376,067 | B2 | 2/2013 | Downton et al. | |
| 8,550,186 | B2 | 10/2013 | Deolalikar et al. | |
| 8,783,382 | B2 | 7/2014 | Ignova et al. | |
| 2009/0000823 | A1 * | 1/2009 | Pirovolou | E21B 7/04 175/61 |
| 2009/0044979 | A1 | 2/2009 | Johnson et al. | |

(Continued)

OTHER PUBLICATIONS

International Search Report and Written Opinion of PCT Application No. PCT/US2016/060060 dated Jul. 26, 2017: pp. 1-15.

*Primary Examiner* — Christopher J Sebesta
*Assistant Examiner* — Yanick A Akaragwe
(74) *Attorney, Agent, or Firm* — K&L Gates LLP

(57) ABSTRACT

A rotary steerable tool for directional drilling includes a tool body with a flowbore, a plurality of extendable members, each independently movable between an extended position and a retracted position, and a plurality of actuation devices, each being independently operable to control a respective one of the extendable members.

21 Claims, 6 Drawing Sheets

(56) References Cited

U.S. PATENT DOCUMENTS

| | | | | |
|---|---|---|---|---|
| 2010/0108386 | A1* | 5/2010 | Martinez | E21B 47/08 175/45 |
| 2012/0145458 | A1 | 6/2012 | Downton | |
| 2013/0118812 | A1 | 5/2013 | Clausen et al. | |
| 2013/0199784 | A1* | 8/2013 | Swadi | E21B 29/06 166/298 |
| 2015/0107902 | A1* | 4/2015 | Downton | E21B 23/04 175/45 |
| 2015/0152723 | A1* | 6/2015 | Hay | E21B 10/62 175/17 |
| 2016/0053546 | A1* | 2/2016 | Samuel | E21B 28/00 175/40 |
| 2016/0084007 | A1 | 3/2016 | Sugiura | |
| 2016/0130878 | A1 | 5/2016 | Cobern | |
| 2017/0218747 | A1* | 8/2017 | Aklestad | E21B 44/005 |
| 2018/0058187 | A1* | 3/2018 | Magnuson | E21B 19/20 |
| 2018/0094490 | A1 | 4/2018 | Lines et al. | |
| 2018/0094516 | A1 | 4/2018 | Mauldin et al. | |
| 2018/0252088 | A1 | 9/2018 | Tilley et al. | |
| 2018/0340374 | A1 | 11/2018 | Moore et al. | |

* cited by examiner

ROTARY STEERABLE DRILLING TOOL AND METHOD WITH INDEPENDENTLY ACTUATED PADS

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

Directional drilling is commonly used to drill any type of well profile where active control of the well bore trajectory is required to achieve the intended well profile. For example, a directional drilling operation may be conducted when the target pay zone is not directly below or otherwise cannot be reached by drilling straight down from a drilling rig above it.

Directional drilling operations involve varying or controlling the direction of a downhole tool (e.g., a drill bit) in a borehole to direct the tool towards the desired target destination. Examples of directional drilling systems include point-the-bit rotary steerable drilling systems and push-the-bit rotary steerable drilling systems. In both systems, the drilling direction is changed by repositioning the bit position or angle with respect to the well bore. Push-the-bit tools use pads on the outside of the tool which press against the well bore thereby causing the bit to press on the opposite side causing a direction change. Point-the-bit technologies cause the direction of the bit to change relative to the rest of the tool.

Dogleg capability is the ability of a drilling system to make precise and sharp turns in forming a directional well. Higher doglegs increase reservoir exposure and allow improved utilization of well bores where there are lease line limitations. Tool face control is a fundamental factor of dogleg capability. Typically, a higher and more precise degree of tool face control increases dogleg capability. In some drilling systems, tool face is controlled by pads or pistons that extend from the drilling tool to push the drill bit in an opposing direction. In such system, a pad or piston is extended as it rolls into the appropriate position and retracted as the pad or piston rolls out of said position. In existing systems, the pads or pistons are generally only extendable one at a time and in a fixed order or pattern, providing low resolution tool face control.

BRIEF DESCRIPTION OF THE DRAWINGS

For a detailed description of the embodiments of the invention, reference will now be made to the accompanying drawings in which.

DETAILED DESCRIPTION

The present disclosure provides systems and methods for directional drilling. Specifically, the present disclosure provides a directional drilling system, such as a rotary steerable system (RSS), with independently actuated extendable pads. The independently actuated pads allow for increased granularity of control over the force vectors applied to the borehole wall by the pads or pistons, thereby more accurately directing the drill bit, enhancing tool face control and dogleg capability.

Figure 1:
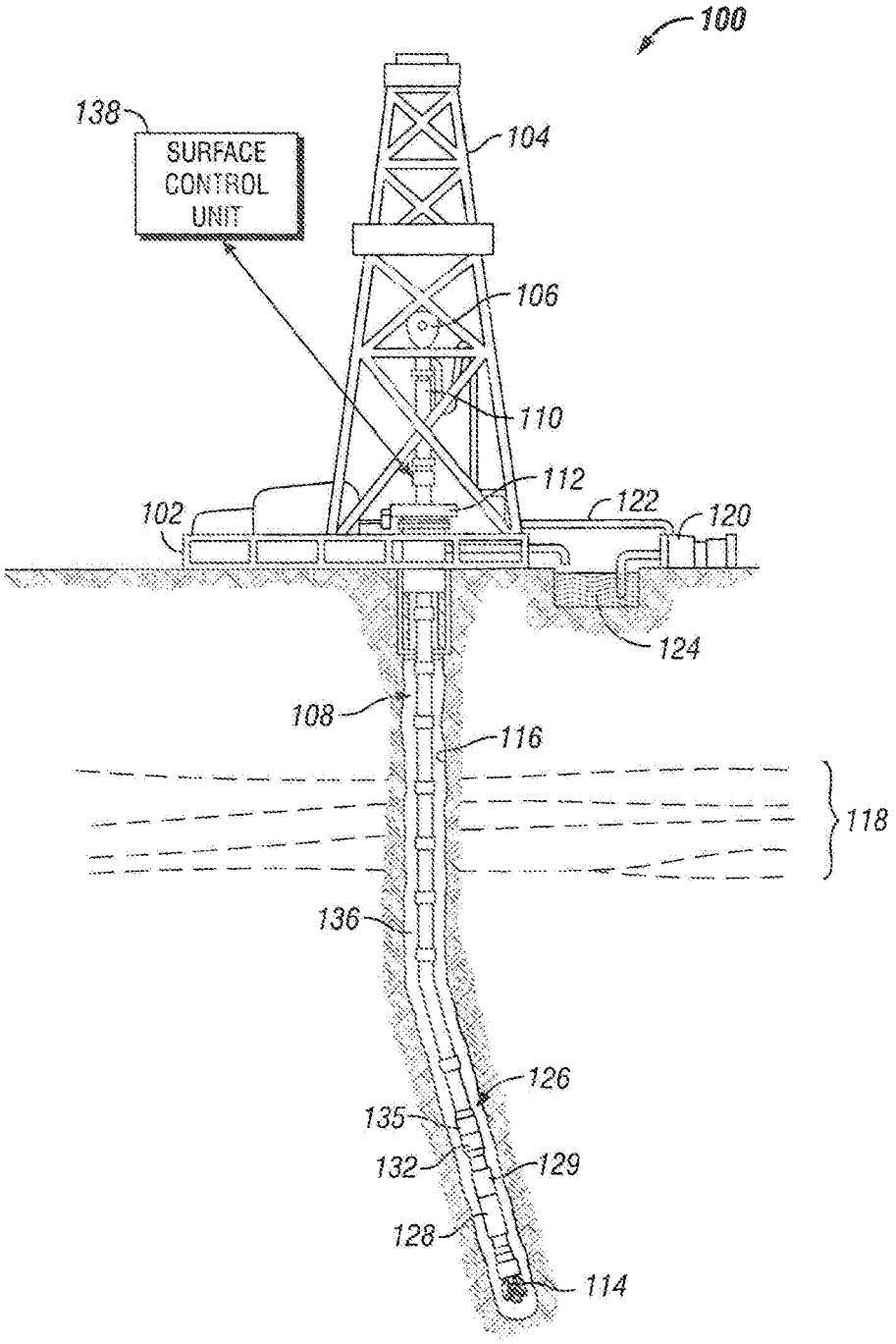
FIG. 1 depicts a schematic view of a directional drilling operation, in accordance with one or more embodiments.

Turning now to the figures, FIG. 1 depicts a schematic view of a drilling operation utilizing a directional drilling system 100, in accordance with one or more embodiments. The system of the present disclosure will be specifically described below such that the system is used to direct a drill bit in drilling a borehole, such as a subsea well or a land well. Further, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

Accordingly, FIG. 1 shows a schematic view of a tool string 126 disposed in a directional borehole 116, in accordance with one or more embodiments. The tool string 126 includes a rotary steerable tool 128 in accordance with various embodiments. The rotary steerable tool 128 provides full 3D directional control of the drill bit 114. A drilling platform 102 supports a derrick 104 having a traveling block 106 for raising and lowering a drill string 108. A kelly 110 supports the drill string 108 as the drill string 108 is lowered through a rotary table 112. In one or more embodiments, a topdrive is used to rotate the drill string 108 in place of the kelly 110 and the rotary table 112. A drill bit 114 is positioned at the downhole end of the tool string 126, and, in one or more embodiments, may be driven by a downhole motor 129 positioned on the tool string 126 and/or by rotation of the entire drill string 108 from the surface. As the bit 114 rotates, the bit 114 creates the borehole 116 that passes through various formations 118. A pump 120 circulates drilling fluid through a feed pipe 122 and downhole through the interior of drill string 108, through orifices in drill bit 114, back to the surface via the annulus 136 around drill string 108, and into a retention pit 124. The drilling fluid transports cuttings from the borehole 116 into the pit 124 and aids in maintaining the integrity of the borehole 116. The drilling fluid may also drive the downhole motor 129.

The tool string 126 may include one or more logging while drilling (LWD) or measurement-while-drilling (MWD) tools 132 that collect measurements relating to various borehole and formation properties as well as the position of the bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 135. The telemetry module 135 receives data provided by the various sensors of the tool string 126 (e.g., sensors of the LWD/MWD tool 132), and transmits the data to a surface unit 138. Data may also be provided by the surface unit 138, received by the telemetry module 135, and transmitted to the tools (e.g., LWD/MWD tool 132, rotary steering tool 128, etc.) of the tool string 126. In one or more embodiments, mud pulse telemetry, wired drill pipe, acoustic telemetry, or other telemetry technologies known in the art may be used to provide communication between the surface control unit 138 and the telemetry module 135. In one or more embodiments, the surface unit 138 may communicate directly with the LWD/MWD tool 132 and/or the rotary steering tool 128. The surface unit 138 may be a computer stationed at the well site, a portable electronic device, a remote computer, or distributed between multiple locations and devices. The unit 138 may also be a control unit that controls functions of the equipment of the tool string 126.

The rotary steerable tool 128 is configured to change the direction of the tool string 126 and/or the drill bit 114, such as based on information indicative of tool 128 orientation and a desired drilling direction or well profile. In one or more embodiments, the rotary steerable tool 128 is coupled to the drill bit 114 and drives rotation of the drill bit 114. Specifically, the rotary steerable tool 128 rotates in tandem with the drill bit 114. In one or more embodiments, the rotary steerable tool 128 is a point-the-bit system or a push-the-bit system.

Figure 2A:
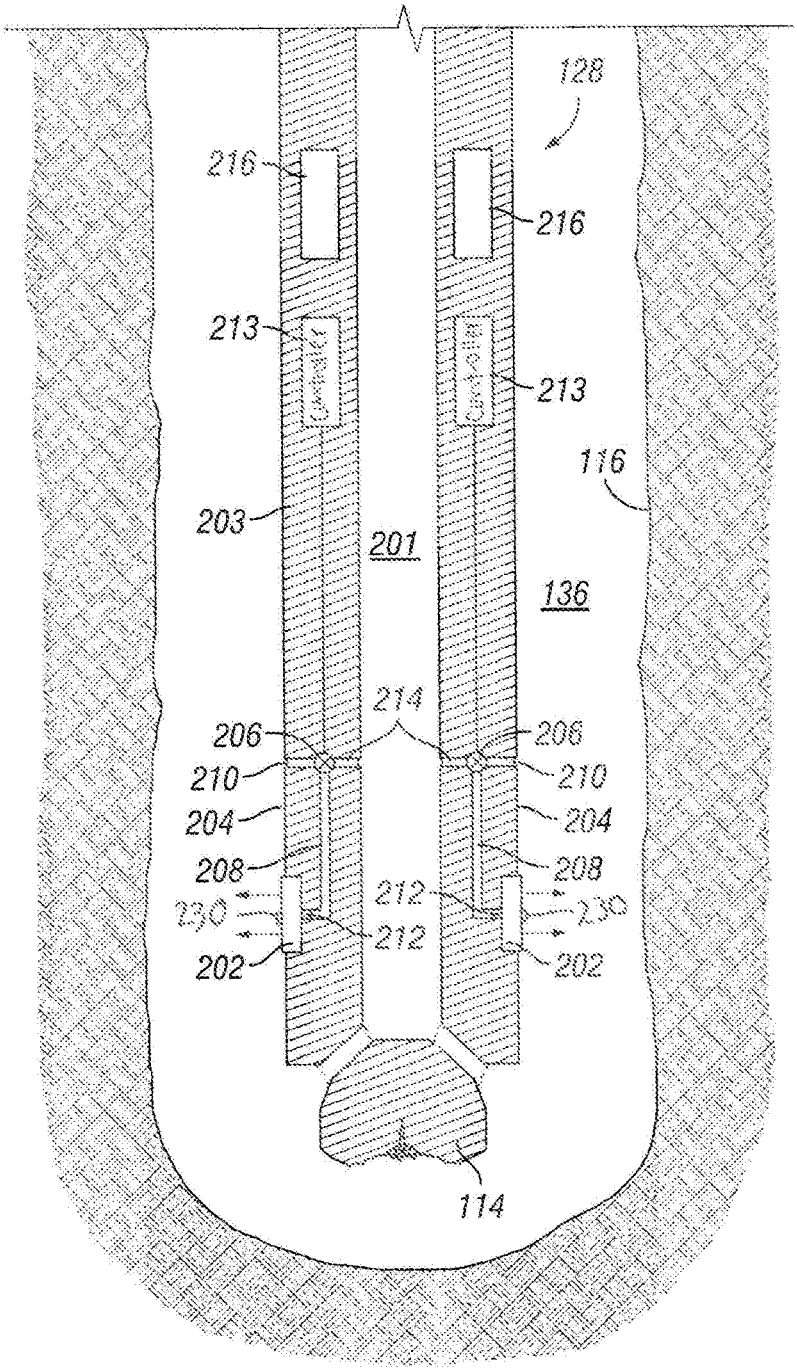
FIG. 2A depicts a cross-sectional schematic view of a rotary steerable tool in the borehole, in accordance with one or more embodiments.

FIG. 2A depicts a cross-sectional schematic view of the rotary steerable tool 128 in the borehole 116, in accordance with one or more embodiments. The rotary steerable tool 128 includes a tool body 203 and a flowbore 201 through which drilling fluid flows. The rotary steerable tool 128 further includes one or more extendable members, such as pads 202, extendable from the outer surface 204 of the rotary steerable tool 128. The pads 202 are configured to extend outwardly from the rotary steerable tool 128 upon actuation to direct the drill bit 114 towards a desired direction. Thus, the pads 202 are actuated into the extended position only when they are in certain rotational orientations. Specifically, for a push-the-bit system, the resultant force of all the actuated pads applied on the wall of the borehole 116 should be in the opposite direction as the desired driving direction of the drill bit 114. As the pads 202 are only put into the extended position when in the appropriate position(s) during rotation of the rotary steerable tool 128, the pads 202 are pulled back to the tool once they are no longer in an appropriate position. In one or more embodiments, hydraulic pressure is directed to the desired pad 202 or an associated piston 212 to actuate the extension of the pad 202. However, any suitable means of actuation, including for example mechanical or electrical actuation, may be used.

As an example of hydraulic actuation, in one or more embodiments, extension of the pads 202 is enabled by generating a pressure differential between the flowbore 201 of the tool string 126 and the annulus 136 surrounding the tool string 126 and inside the borehole 116. Specifically, the pads 202, or intermediate actuation devices such as pistons 212, are each coupled to the flowbore 201 via a supply path 214 and actuation path 208 formed in the tool body 203. The actuation path 208 is also coupled to a bleed path 210 formed in the tool body which hydraulically couples to the annulus 136.

For each pad 202, an actuation device, such as a valve 206, may be placed in or around the supply path 214, the actuation path, at the respective piston 212, or at the pad 202. The valve 206 controls the flow of hydraulic fluid, such as drilling fluid, therethrough. The valve 206 can be controlled to hydraulically couple and decouple the actuation path 208 from the supply path 214. The valve 206 controls the hydraulic pressure applied to the respective pad 202, thereby controlling extension of the pad 202. Each pad 202 is controlled by a unique actuation device and each actuation device is independently controlled. Thus, the extension of each pad 202 is independently controlled. The actuation device can include a solenoid valve, a linear motor, an electric motor, a piezoelectric device, among others.

Figure 2B:
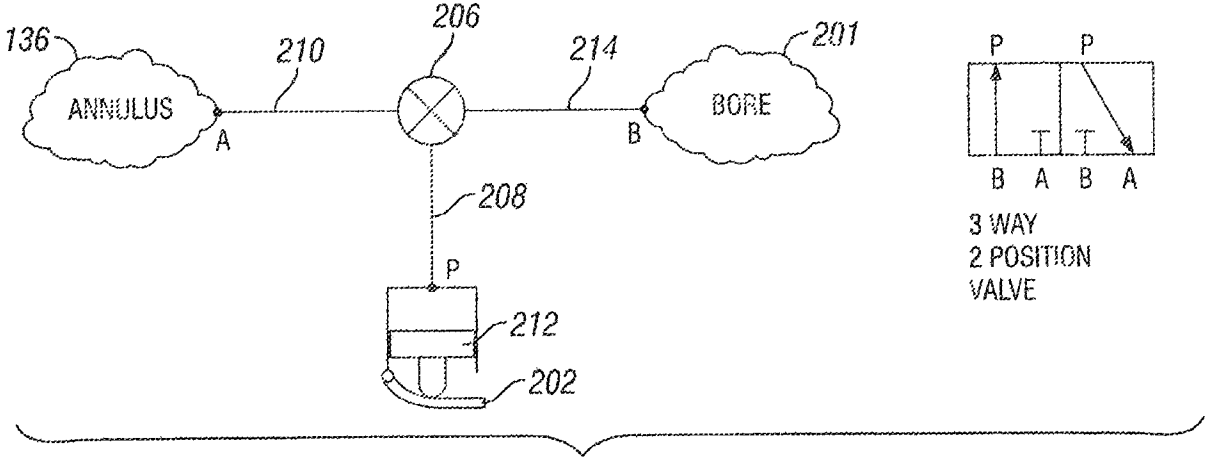
FIGS. 2B and 2C depict high level examples of hydraulic circuit configurations, in accordance with one or more embodiments.
Figure 2C:
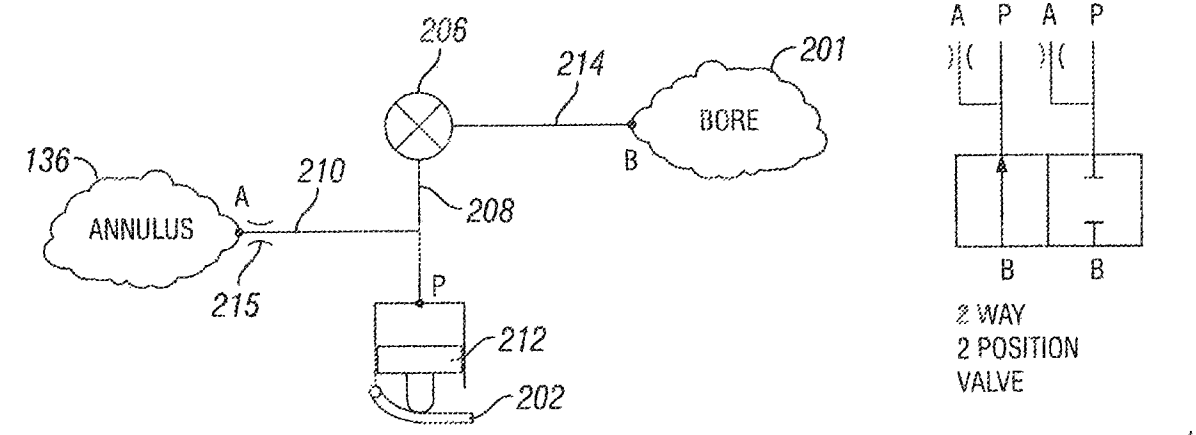

Example hydraulic circuit configurations include but are not limited to the following configurations as depicted in FIGS. 2B and 2C. As depicted in FIG. 2B, when the valve 206 is actuated, the actuation path 208 and the supply path 214 are coupled to the flowbore 201. Due to the pumping of drilling fluid into the flowbore 201 and the pressure drop at the bit, the flowbore 201 is at a high pressure relative to the annulus 136. As a result drilling fluid flows into the actuation path 208 from the flowbore 201. The increase in pressure in the actuation path 208 actuates extension of the piston 212 and pad 202. During actuation, the actuation path 208 is closed to the bleed path 210 and thus full differential pressure between the flowbore 201 and annulus 136 is applied to the piston 212. During deactivation of the valve 206, or retraction of the pad 202, the actuation path 208 is open to the bleed path 210 and piston 212 is allowed to push the fluid to the annulus 136 via the bleed path 210.

As depicted in FIG. 2C, when the valve 206 is actuated, the actuation path 208, supply path 214, and bleed path 210 are coupled to the flowbore 201 and to each other. Due to the pumping of drilling fluid into the flowbore 201 and the pressure drop at the bit, the flowbore 201 is at a high pressure relative to the annulus 136. As a result, drilling fluid flows into the actuation path 208 and bleed path 210 from the flowbore 201. The increase in pressure in the actuation path 208 actuates extension of the piston 212 and pad 202. It should be noted that some volume of fluid is flowing to the annulus via the bleed path 210, and that sufficient restriction 215 is necessary to maintain sufficient pressure differential between the flowbore 201 and annulus 136 in order to extend the piston 212 and pad 202. During deactivation of the valve 206, the actuation path 208 is open to the bleed path 210 and piston 212 is allowed to push the fluid to the annulus 136 via the bleed path 210. In one or more embodiments, the piston 212 is coupled to the actuation path and the increase in pressure actuates a piston 212. The piston 212 may extend outward upon actuation and push the pad 202 outward. In one or more embodiments, the pad 202 is absent and the piston 212 pushes against the borehole 116.

Each pad 202 can be opened independently through actuation of the respective valve 206. Any subset or all of the pads 202 can be opened at the same time, in a staggered, overlapping scheme, or in any fashion that pushes the drill bit 114 in the desired direction at the desired location. In some embodiments, the valves 206 are controlled by a central controller 213. In one or more embodiments, the amount of force by which a piston 212 or pad 202 pushes against the borehole 116 or the amount of extension may be controlled by controlling the flow of drilling fluid into the respective actuation path 208, which can be controlled via the valve 206 or various other valves or orifices placed along the actuation path 208 or the bleed path 210. This helps enable control over the degree of direction change of the drill bit 114.

The rotary steerable tool 128 may also contain one or more logging sensors 216 for making any measurement including measurement while drilling data, logging while drilling data, formation evaluation data, and other well data. The rotary steerable tool 128 may also include feedback sensors 230 which provide feedback regarding parameters such as pad displacement, force or pressure applied by a pad 202 onto the borehole, force or pressure applied by to the pad 202 (e.g., fluid pressure), force or pressure applied by the drill bit 114 onto the borehole, orientation and positional parameters of the pads 202, the drill bit 114 or tool 128, and the like. The feedback data is communicated to the central controller 213 and/or the surface control unit 138 and provides information for adjusting control of the rotary steerable tool 128 and/or the pads 202. The feedback sensors 230 may include but are not limited to strain gauges, Hall effect sensors, potentiometers, linear variable transformers, the like, and in any combination. The feedback sensors 230 may be coupled to the various parts of the rotary steerable tool 128, the drill bit, the pads, among others, or the sensors may be remote to the rotary steerable tool 128.

Figure 3:
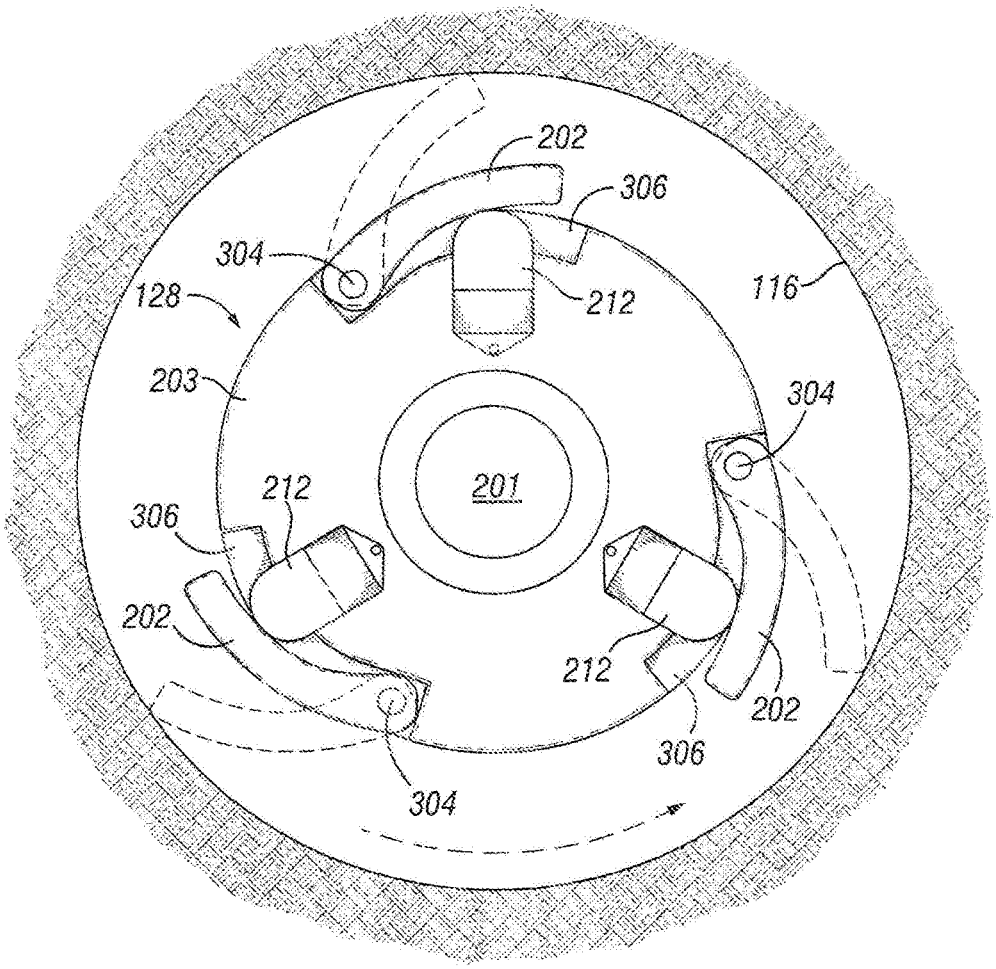
FIG. 3 depicts a radial cross-sectional schematic view of the rotary steerable tool, in accordance with one or more embodiments.

FIG. 3 depicts a radial cross-sectional schematic view of the rotary steerable tool 128, showing the pads 202, in accordance to one or more embodiments. As shown, the pads 202 are close to the tool body 203 in a retracted position and movable outward into an extended position. In the illustrated example, the pads 202 are coupled to the tool body 203 and pivot between the retracted and extended positions via hinges 304. As mentioned above, the pads 202 can be pushed outward and into the extended position by the pistons 212. In the illustrated embodiment, the tool body 203 includes recesses 306 which house the pads 202 when in the retracted position, thereby allowing the pads 202 to be flush with the tool body 203. The pads 202 can be extended to varying degrees. The extended position can refer to any position in which the pad 202 is extended outwardly beyond the retracted position and not necessarily fully extended. "Retraction" or "retracting" refers to the act of bringing the pad 202 inward, or moving the pad 202 from a more extended position to a less extended position, and does not necessarily refer to moving the pad 202 into a fully retracted position. Similarly, "extension" or "extending" refers to the act of moving the pad outward, such as from a less extended position to a more extended position, and does not necessarily refer to moving the pad 202 into a fully extended position.

As shown, the rotary steerable tool 128 includes three pads spaced 120 degrees apart around the circumference of the tool 128. However, the rotary steerable tool 128 can have more or less than the three pads 202 shown. The pad 202 and piston 212 mechanism is just one configuration of an extendable mechanism designed to push against the wall of the borehole 116 to urge the drill bit 114 in a direction. The rotary steerable tool 128 may include various other types of extendable members or mechanisms, including but not limited to pistons configured to push against the borehole 116 directly or pads 202 configured to be acted on by drilling fluid direction without an intermediate piston.

The pads 202, or alternative extendable members or mechanism, may also include a retraction mechanism that moves the pads 202 back into the closed position. In some other embodiments, the pads 202 may be configured to fall back into the closed position when pressure applied by the drill fluid at the pads 202 drops. In some embodiments, the pads 202 are coupled to the piston 212 and thus travel with the piston 212. In one or more embodiments, the pads 202 may also function as centralizers, in which all the pads 202 remain in the extended position, keeping the rotary steerable tool 128 centralized in the borehole 116.

Figure 4:
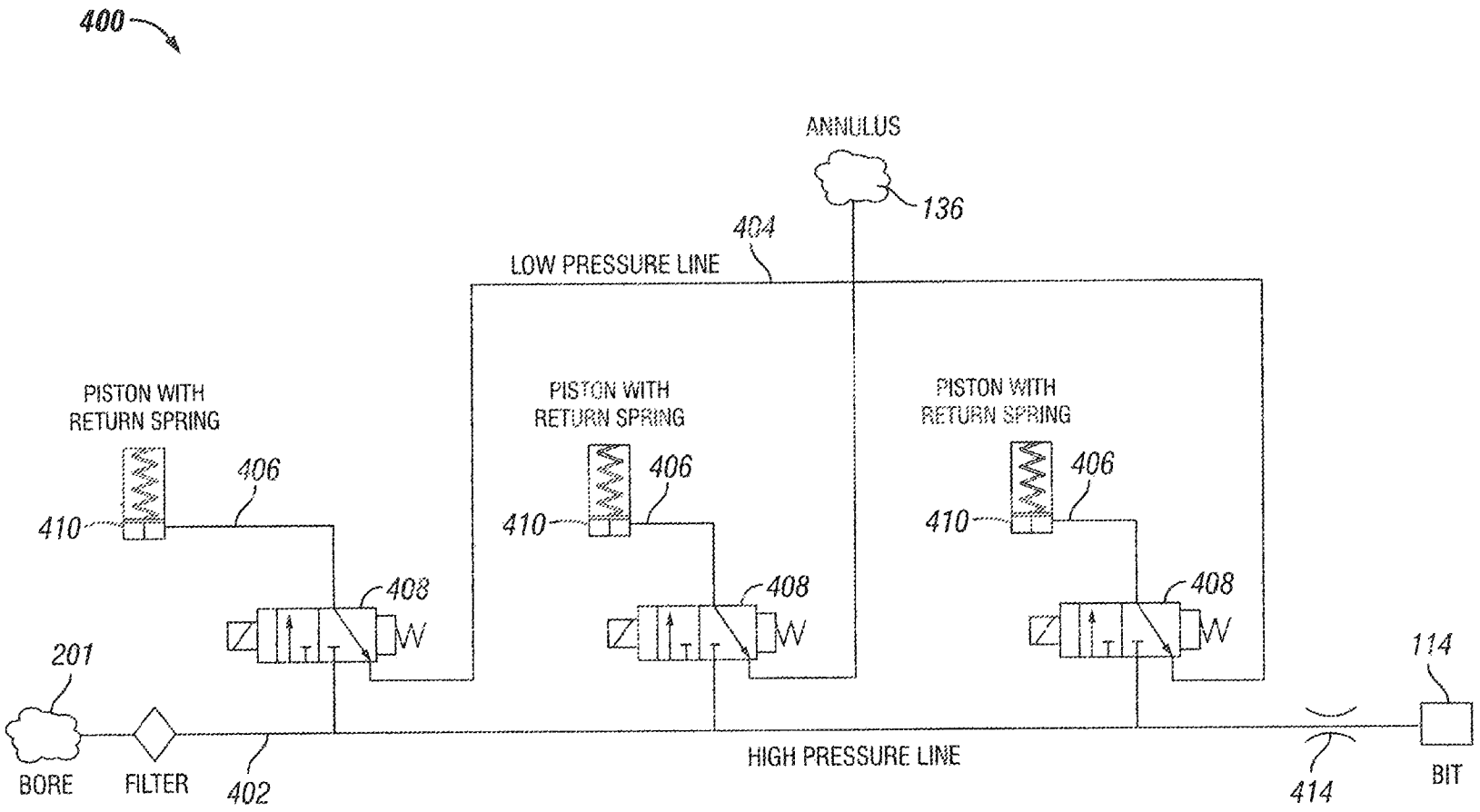
FIG. 4 depicts an example hydraulic circuit of the rotary steerable tool, in accordance with one or more embodiments.

FIG. 4 depicts an example hydraulic circuit 400 of the rotary steerable tool 128 using hydraulic actuation to move the pads 202, in accordance with one or more embodiments. This hydraulic circuit 400 includes multiple 3 way-2 position valves that utilize differential drilling fluid pressure between the flowbore 201 and the annulus 136 to actuate corresponding pistons 410, which facility extension of pads 202. Specifically, the hydraulic circuit 400 utilizes a pressure differential between the drilling fluid pumped into the rotary steerable tool 128 and the annulus 136 around the rotary steerable tool 128. The hydraulic circuit 400 includes a high pressure line 402, which represents the inside of the tool into which fluid is pumped, and a low pressure line 404, which represents the annulus 136. The high pressure line 402 is coupled to the drill bit 114, which provides flow restriction and the resulting differential pressure. Additionally, a flow restrictor 414 can be added to increase pressure differential in the case that the bit, alone, does not provide a sufficient pressure differential.

The high pressure line 402 is coupled to a plurality of actuation devices, such as valves 408. Each valve 408 is also coupled to the low pressure line 404 and a hydraulic piston line 406, which is coupled to the respective piston 410. The valves 408 controllably separate the high pressure line 402 from the hydraulic piston lines 406, thereby controllably separating the high pressure line 402 from the pistons 410. In one or more embodiments, each valve 408 is coupled to a distinct hydraulic piston line 406 and piston 410.

The valves 408 are individually controlled to couple or decouple the high pressure line 402 and each of the hydraulic piston lines 406. Specifically, in one or more embodiments, when an electrically actuated valve 408 is actuated, the high pressure line is in fluid communication with the respective hydraulic piston line 406 and the respective piston 410. The pressure differential between the low pressure line 404 and the high pressure line 402 pushes drilling fluid through the respective hydraulic piston line 406, thereby actuating the piston 410. Actuation of the piston 410 causes pad extension or another protrusion to extend outwardly from the rotary steerable tool 128, applying a force on the borehole, thereby changing the drilling direction. When a valve 408 is deactivated or closed, the respective piston 410 is isolated from the high pressure line 402, and the piston 410 is in fluid communication with the low pressure line 404, allowing the piston 410 to retract and drain fluid through the low pressure line 404 to the annulus 136.

FIG. 4 illustrates one example of many hydraulic circuits suitable for the techniques of the present disclosure. In one or more embodiments, the hydraulic circuit uses self-contained hydraulic fluid rather than drilling fluid and circulates the fluid using a pump or the like rather than relying on pressure differential between the flowbore 201 and the annulus 136.

Due to the extension pads 202 being independently controllable, the rotary steerable tool 128 allows for refined control of drilling direction. Specifically, the rotary steerable tool 128 provides reduced movement of the target eccentric location during steering. As the ultimate drilling direction can be the result of multiple force vectors, created by extension of multiple pads, the tool 128 can be force balanced in complex ways to bring about the desired drilling profile. In one or more embodiments, force balancing is done through downlinkable calibration, in which sensor feedback regarding position, force, etc., as described above, is used to adjust the force and/or timing of each pad extension as the tool 128 sweeps through tool face angles. These adjustments help maintain desired tool face, borehole center, eccentric target location, and well profile. In one or more embodiments, the pads of the rotary steerable tool may be operated according to a base extension scheme and a variable calibration scheme may be superimposed on top of the base scheme to adjust the pad extensions as needed.

In one example application, a pad may be actuated to begin extending before it reaches the actual position at which to push the borehole such that by the time the pad reaches the position, the pad will be in the extended position, compensating for a lag in time it takes the pad to reach the extended position.

In another example application, a well may have unanticipated unevenness. Thus, the timing, location, and/or force of pad extension may be adjusted accordingly to achieve the desired borehole or tool face.

In another example application, the rotary steerable tool may be configured to skip pad extension cycles if the RPM of the tool becomes too high. For example, if the RPM is too high for the actuation time of the pads, the pad may be controlled to extend every other cycle or even less frequently. Furthermore, extension of the pads of the rotary steerable tool may be calibrated for intra-revolution changes in RPM, in which the rotational speed of the tool is not consistent during a single revolution. This may be caused by various conditions, such as stick-slip, erratic torque, formation structures, among others. The feedback response includes direct and/or indirect measurements of the angular position and rotational speed, which is used to modify timing of the firing of the pads. This facilitates drilling at higher RPM and reduces wear on the pads. Frequency of pad extension may be controlled through pulse width modulation.

In another example application, when directional drilling a well with a horizontal component, the tool may experience gravitational effects which may affect tool face if unaccounted for. Specifically, gravity may pull the tool face closer towards low-side than intended. Thus, in order to calibrate for such effects, the pads may be controlled to produce a tool face closer to high-side than intended. Thus, when exposed to gravitational effects, the actual tool face is in the desired direction.

In another example, the rotary steerable tool can retract all the pads simultaneously. A fail-safe mode may be activated when there is an absence of a threshold differential pressure between the bore of the tool and the annulus in which the threshold is calibrated during the operation. However, this fail-safe mode may be manually overridden such that steering can continue in conditions with undesireably low differential pressure.

In another example, the rotary steerable tool maintains steering control during stick-slip conditions or other drilling disturbances. This is achieved by intentionally aliasing the high frequency stick and slip with the goal of pushing the bit generally in the desired drilling direction. The rotary steerable tool is configured to detect stick and slip via one or more sensors, determine the frequency of the stick-slip, intentionally alias the stick-slip frequency, and fire rapid bursts of pad extension in the appropriate position to direct the drill bit in the desired direction. In some conditions, if the stick-slip frequency is highly variable, aliasing may be replaced with direct measurements. Due to the irregular tool behavior caused by stick-slip, the rotary steerable tool is configured to calibrate pad extension accordingly to maximize pushing of the tool generally towards the desired direction.

Figure 5:
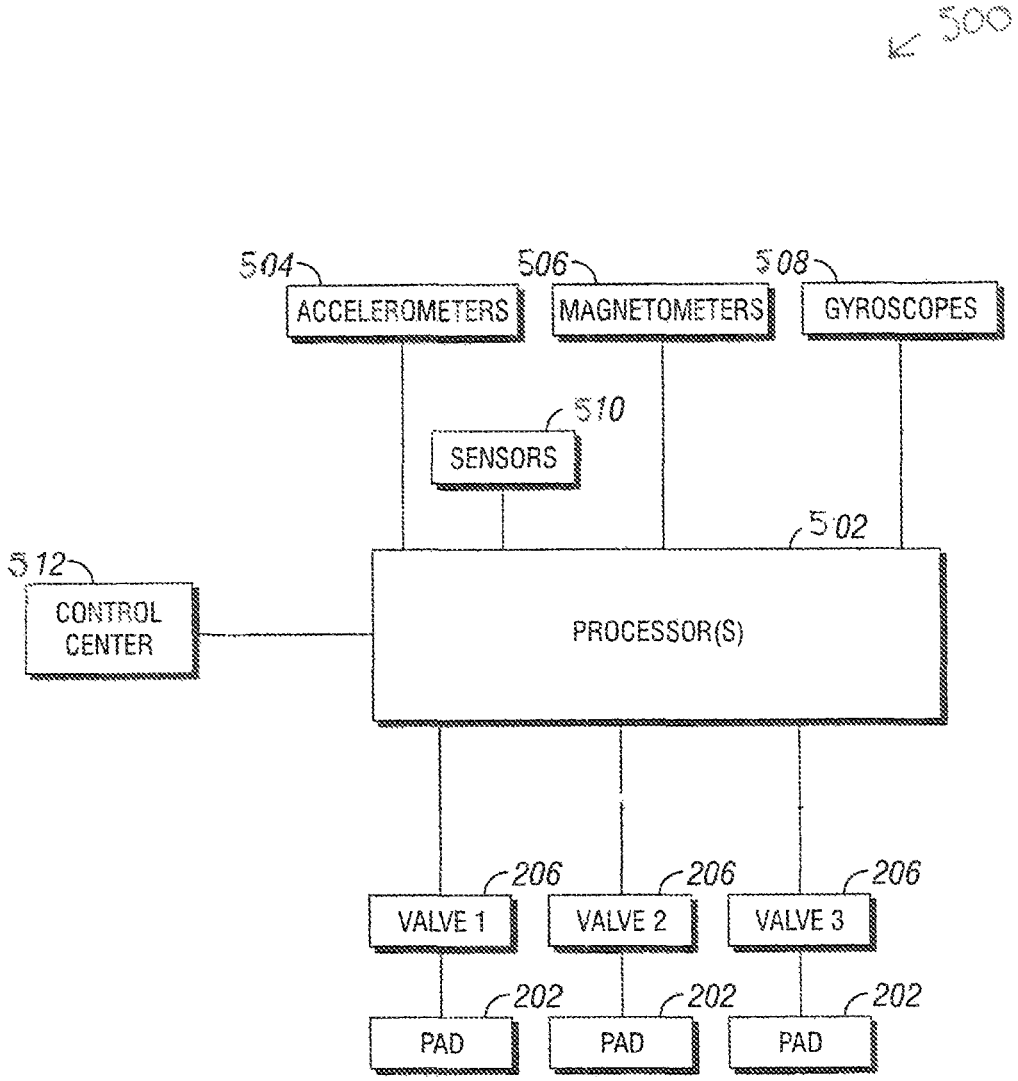
FIG. 5 depicts a block diagram of a control system of the rotary steerable tool, in accordance with one or more embodiments.

FIG. 5 depicts a block diagram of a control system 500 of the rotary steerable tool, in accordance with one or more embodiments. The control system 500 includes a processor 502 and a suite of sensors, including directional sensors such as accelerometers 504, magnetometers 506, and gyroscopes 508, and the like for determining an azimuth or tool face angle of the drill bit 114 to a reference direction (e.g., magnetic north) and other positional parameter. The control system 500 may include any number of these sensors and in any combination. Based on the azimuth and a desired drilling direction or drilling path, the rotary steerable tool 128 determines a suitable control scheme to steer the tool string 126 and drill bit 114 in the desired direction, thereby creating a directional borehole. The control system 500 utilizes the sensors to maintain a geopositional reference for steering of the rotary steerable tool 128. The processor 502 may also be coupled to various other sensors 510 such as temperature sensors, magnetic field sensors, and rpm sensors, among others. Specifically, the sensors 510 may include the feedback sensors 230 of FIG. 2 used for calibrating drilling control. The sensors 510 may be embedded anywhere on the rotary steerable tool 128 or remote from the rotary steerable tool 128 and are configured to transmit data to the processor 502.

The processor 502 is configured to independently control the pads 202 through actuation of the valves 206 according to the measurements made by the sensors as well as a profile of the drilling operation, thereby controlling the drilling direction of the drill bit 114. The profile of the drilling operation may include information such as the location of the drilling target, type of formation, and other parameters regarding the specific drilling operation. As the tool 128 rotates, the sensors (e.g., accelerometers 504, magnetometers 506, and gyroscopes 508) continuously feed measurements to the processor 502 while rotating with the tool 128. The processor 502 uses the measurements to continuously track the position of the tool 128 with respect to the target drilling direction in real time. From this the processor 502 can determine which direction to direct the drill bit 114. Since the location of the pads 202 are fixed with respect to the tool 128, the location of the pads 202 can be easily derived from the location of the tool 128. The processor 502 can then determine when to actuate the pads 202 in order to direct the drill bit 114 in the desired direction.

Each of the pads 202 on the tool 128 can be actuated independently, in any combination, and at any time interval, which allows for agile, fully three dimensional control of the direction of the drill bit 114. The directional control may be relative to gravity tool face, magnetic tool face, or gyro tool face. Additionally, the processor 202 receives feedback during drilling and generates control schemes for calibrating or modifying control of the pads 202. Frequency of pad 202 extensions may depend on the speed of rotation of the tool 128 and the desired rate of direction change. For example, if the tool 128 is rotating at a relatively high speed, a pad 202 may only be actuated every other rotation. Similarly, if the desired rate of direction change of the tool 128 is high, the pad 202 may be actuated at a higher frequency than if the desired rate of direction change were lower.

The processor 502 is in communication with a control center 512. The control center 512 may send instructions or information to the processor such as the information related to the profile of the drilling operation such as location of the drilling target, rate of direction change, and the like. In one or more embodiments, the control center 512 may receive spontaneous control commands from an operator which are relayed as processor-readable commands to the processor 502. In some other embodiments, the control center 512 sends preprogrammed commands to the processor 502 set according to the profile of the drilling operation. The control system 500 receives power from a power source. Examples of power sources include batteries, mud generators, among others. The power supply actually used in a specific application can be chosen based on performance requirements and available resources.

This present disclosure provides a rotary steerable tool with independent control of a plurality of pads or extendable members that can be fired at any sequence with any time open. This allows for sophisticated drilling control, including higher dogleg capability, force balancing, the ability to control extension frequency of pad extensions on the fly, correction of tool face offset, and adapting to drilling disturbance such as stick-slip. For example, by including a tool face that is controlled by independently controlled extendable members (e.g., pads) and/or actuation devices (e.g., pistons), a tool is able to increase the dogleg severity to achieve a dogleg between about 10° to 15° per 100 ft (30.5 m) or higher within a drilled borehole. Other factors may also affect the dogleg, such as tool flexibility, speed of the actuation devices, and/or stroke of the extendable members. Certain aspects of such control may be handled by the tool/control unit autonomously without operator intervention, such as automatically adjusting control parameters based on feedback data.

In addition to the embodiments described above, many examples of specific combinations are within the scope of the disclosure, some of which are detailed below:

Example 1

A rotary steerable tool for directional drilling, comprising:

a tool body including a flowbore;

a plurality of extendable members, each independently movable between an extended position and a retracted position; and a plurality of actuation devices, each being independently operable to control a respective one of the extendable members.

Example 2

The tool of any Example above, wherein each actuation device includes a solenoid valve, a linear motor, an electric motor, or a piezoelectric device.

Example 3

The tool of any Example above, wherein any extendable member is extendable and retractable regardless of the position of any other extendable member.

Example 4

The tool of any Example above, wherein each actuation device is controlled by a central controller.

Example 5

The tool of any Example above, further comprising a sensor coupled to one of the extendable members, the rotary steerable tool, or both, and configured to provide a feedback parameter.

Example 6

The tool of any Example above, wherein the feedback parameter includes a force applied by one of the extendable members, a pressure applied to one of the extendable members, a displacement of one of the extendable members, a tool face, a bit force, a bit direction, or any combination thereof.

Example 7

The tool of any Example above, wherein the sensor is communicative with the central controller, directly or indirectly, and wherein the central controller is configured to receive the feedback parameter and calibrate control of the actuation devices using the feedback parameter.

Example 8

The tool of any Example above, wherein each actuation device is configured to couple the respective extendable member to a hydraulic pressure, thereby actuating extension of the respective extendable member.

Example 9

The tool of any Example above, further comprising a drill bit, wherein a tool face, position, and/or orientation of the drill bit is controlled by the plurality of extendable members.

Example 10

A method of directionally drilling a borehole, comprising:

rotating a tool within the borehole, wherein the tool including a plurality of extendable members;

tracking, directly or indirectly, a position of each of the extendable members; and independently moving any of the extendable members between a retracted position and an extended position to selectively apply a force against the borehole and push the tool in a target direction.

Example 11

The method of Example 10, further comprising controlling each of the extendable members via a unique actuation device.

Example 12

The method of any of Examples 10 to 11, further comprising:

detecting a difference between a desired position, tool face, or pad force of the tool and an actual position, tool face, or pad force of the tool, and controlling movement of one or more of the plurality of extendable members to decrease the difference.

Example 13

The method of any of Examples 10 to 12, further comprising:

controlling the plurality of extendable members according to a base scheme; and adjusting control of the plurality of extendable members according to a correction scheme, wherein the correction scheme is superimposed onto the base scheme to reach the target direction.

Example 14

The method of any of Examples 10 to 13, further comprising detecting a force, a pressure, or a displacement of the tool or one of the extendable members.

Example 15

The method of any of Examples 10 to 14, further comprising moving one of the extendable members while another of the extendable members is at least partially extended from the tool.

Example 16

The method of any of Examples 10 to 15, further comprising moving the extendable member using a hydraulic source upon operating the respective actuation device.

Example 17

The method of any of Examples 10 to 16, further comprising independently coupling each extendable member to the same hydraulic source via the respective actuation devices.

Example 18

The method of any of Examples 10 to 17, further comprising moving one or more of the extendable members at a frequency lower than once every revolution.

Example 19

The method of any of Examples 10 to 18, further comprising drilling a dogleg severity of at least 10° per 100 ft (30.5 m) with the tool for the borehole.

Example 20

A method of directionally drilling a borehole, comprising:

detecting a difference between a desired drilling parameter and an actual drilling parameter; and adjusting control of a plurality of independently controllable extendable members to minimize the difference.

Example 21

The method of Example 20, further comprising autonomously adjusting control of the plurality of independently controllable extendable members.

Example 22

The method of any of Examples 20 to 21, wherein the drilling parameter is tool face, force on borehole, position, eccentric tool location, or any combination thereof.

Example 23

The method of any of Examples 20 to 22, further comprising:

determine a frequency during a stick-slip event; and aliasing the stick-slip frequency.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A rotary steerable tool for directional drilling, comprising:

a tool body including a flowbore;

a plurality of extendable members, each independently movable between an extended position and a retracted position;

a plurality of actuation devices, each being independently operable to control a respective one of the extendable members to steer the tool body in a target direction; and a sensor operable to provide a first feedback parameter, the first feedback parameter comprising displacement of the extendable members, force or pressure applied by the extendable members, force or pressure applied to the extendable members, or orientation and positional parameters of the extendable members; and a controller operable to control a position and a force applied by each of the extendable members according to a base control scheme for controlling the extendable members to steer the tool body in the target direction, wherein the controller is communicative with the sensor and operable to calibrate the base control scheme based on the first feedback parameter to adjust at least one of the force applied by or the position of the extendable members to steer the tool body in the target direction.

2. The tool of claim 1, wherein each actuation device includes a solenoid valve, a linear motor, an electric motor, or a piezoelectric device.

3. The tool of claim 1, wherein any extendable member is extendable and retractable regardless of a position of any other extendable member.

4. The tool of claim 1, wherein each actuation device is controlled by the controller.

5. The tool of claim 1, further comprising a sensor coupled the rotary steerable tool, the sensor operable to provide a second feedback parameter.

6. The tool of claim 1, wherein each actuation device couples the respective extendable members to a hydraulic pressure, thereby actuating extension of the respective extendable member.

7. The tool of claim 1, further comprising a drill bit, wherein a tool face, position, and/or orientation of the drill bit is controlled by the plurality of extendable members.

8. The tool of claim 1, wherein the first feedback parameter further comprises a pressure applied to one of the extendable members, a displacement of one of the extendable members, a tool face, a bit force, a bit direction, or any combination thereof.

9. A method of directionally drilling a borehole, comprising:

rotating a rotary steering tool within the borehole, wherein the tool including a plurality of extendable members;

determining, directly or indirectly, a first feedback parameter, the first feedback parameter comprising a displacement of, a force or pressure applied by, a force or pressure applied to, an orientation, or a position of each of the extendable members via a plurality of sensors;

independently moving any of the extendable members between a retracted position and an extended position to selectively apply a force against the borehole with the extendable members and steer the tool in a target direction;

controlling a position and a force applied by each of the extendable members using a controller according to a base control scheme for controlling the extendable members to steer the tool in a target direction; and calibrating the base control scheme based on the first feedback parameter to adjust at least one of the force applied by or the position of the extendable members to steer the tool in the target direction.

10. The method of claim 9, further comprising controlling each of the extendable members via a unique actuation device.

11. The method of claim 10, further comprising moving each of the extendable members using a hydraulic source upon operating the respective actuation device.

12. The method of claim 11, further comprising independently coupling each extendable member to the same hydraulic source via the respective actuation devices.

13. The method of claim 9, further comprising: determining a difference between a desired position or tool face of the tool and an actual position or tool face of the tool, and calibrating the base control scheme to decrease the difference.

14. The method of claim 9, further comprising detecting a force, a pressure, or a displacement of the tool.

15. The method of claim 9, further comprising moving one of the (Original) extendable members while another of the extendable members is at least partially extended from the tool.

16. The method of claim 9, further comprising moving one or more of the extendable members at a frequency lower than once every revolution.

17. The method of claim 9, further comprising drilling a dogleg severity of at least 10 degrees per 100 feet (30.5 meters) with the tool for the borehole.

18. A method of directionally drilling a borehole, comprising:

controlling a position and a force applied by extendable members of a rotary steerable tool independently using a controller according to a base control scheme for controlling the extendable members to directionally drill the borehole in a target direction;

detecting a difference between a desired drilling parameter comprising a desired displacement of, a desired force or pressure applied by, a force or pressure applied to, an orientation, or a position of each of the extendable members and an actual drilling parameter comprising an actual force applied by each of the extendable members determined via a plurality of sensors; and calibrating the control scheme for the extendable members to adjust at least one of the force applied by or the position of the extendable members and to minimize the difference and steer the tool to directionally drill the borehole in the target direction.

19. The method of claim 18, further comprising autonomously calibrating the base control scheme.

20. The method of claim 18, wherein the drilling parameter further comprises tool face, position, eccentric tool location, or any combination thereof.

21. The method of claim 18, further comprising:

determining a stick-slip frequency during a stick-slip event; and wherein calibrating the control scheme comprises at least one of aliasing the stick-slip frequency or using direct measurements, to steer the tool generally in the target direction.

* * * * *